United States Patent [19]

Spaulding et al.

[11] Patent Number: 4,836,448

[45] Date of Patent: Jun. 6, 1989

[54] THERMAL SPRAY GUN WITH FAN SPRAY

[75] Inventors: Mark F. Spaulding, Yaphank; Richard A. Goehring, Huntington, both of N.Y.

[73] Assignee: The Perkin-Elmer Corporation, Norwalk, Conn.

[21] Appl. No.: 152,196

[22] Filed: Feb. 4, 1988

[51] Int. Cl.[4] ..... B05B 1/24

[52] U.S. Cl. ..... 239/79; 239/135; 239/545

[58] Field of Search ..... 406/193, 194; 118/302; 427/422, 423; 239/654, 135, 418, 74, 85, 80, 543, 545

[56] References Cited

U.S. PATENT DOCUMENTS

| | | | |
|---|---|---|---|
| 930,193 | 8/1904 | Kittle | 239/545 X |
| 2,741,508 | 4/1956 | Marantz | 299/28.6 |
| 2,746,883 | 5/1956 | Powers | 427/423 |
| 2,821,346 | 1/1958 | Fisher | 406/194 X |
| 3,028,257 | 4/1962 | Surchek | 117/46 |
| 3,159,348 | 12/1964 | Wedon | 239/85 |
| 3,642,211 | 2/1972 | Place | 239/595 X |
| 4,192,460 | 3/1980 | Matsuo | 239/79 |
| 4,619,562 | 10/1986 | Brannstrom | 406/193 X |

*Primary Examiner*—Andres Kashnikow
*Assistant Examiner*—Kevin P. Weldon
*Attorney, Agent, or Firm*—H. S. Ingham; E. T. Grimes

[57] ABSTRACT

A thermal spray gun includes a first burner for producing a first fan-shaped flame, a second burner for producing a second fan-shaped flame parallel to the first in sufficient proximity to commingle into a combined fan-shaped flame. Powder is dispersed into a fan-shaped powder spray entrained between the first and second flames. The gun body has a fan-shaped powder chamber with an open side opening forwardly from the gun body between the first flame and the second flame and with an apex location opposite the open side. First and second powder ducts each terminate at the apex location with a common axis perpendicular to the fan-shaped chamber such as to mutually impinge the first and second powder streams into a combined powder stream dispersing through the fan-shaped powder chamber into the fan-shaped powder spray. A first fan-shaped air flow is introduced between the first flame and the fan-shaped air flow is introduced between the first flame and the fan-shaped powder spray, and a second fan-shaped air flow is introduced between the second flame and the fan-shaped powder spray.

10 Claims, 4 Drawing Sheets

THERMAL SPRAY GUN WITH FAN SPRAY

This invention relates to thermal spray guns and particularly to a thermal spray gun for producing a fan-shaped spray.

BACKGROUND OF THE INVENTION

Thermal spraying, also known as flame spraying, involves the heat softening of a heat fusible material such as metal or ceramic, and propelling the softened material in particulate form against a surface which is to be coated. The heated particles strike the surface where they are quenched and bonded thereto. A conventional thermal spray gun is used for the purpose of both heating and propelling the particles. In one type of thermal spray gun, the heat fusible material is supplied to the gun in powder form. Such powders are typically comprised of small particles, e.g., between 100 mesh U. S. Standard screen size (149 microns) and about 2 microns.

In certain instances it is highly desirable that a thermal spray gun produce a fan-shaped spray stream with an increased width. The purpose is to spray large areas quickly and with a minimum of waviness in thickness that may occur with ordinary, concentrated spray streams. Fan sprays would be particularly useful for producing corrosion resistant coatings which are typically on large areas, the coatings being, for example, of zinc, aluminum, or plastic. Another large-area application is for antifouling on pilings and ship hulls in sea water. It happens that these coating materials have relatively low melting points, so it is important that the thermal spray gun produce enough heat for heat softening or melting the powdered material being sprayed but not such as to oxidize or deteriorate it.

Several prior types of powder thermal spray guns have been known for producing fan sprays. For example, U.S. Pat. No. 4,192,460 (Matsuo) discloses a gun with a longitudinal row of holes for injecting powder between two other parallel rows of flame jets. This may produce a wide spray stream but is cumbersome, relatively inefficient and not as uniform a coater as may be desired.

U.S. Pat. No. 2,741,508 (Marantz) shows a broadened nozzle with a slotted orifice for propelling powder through an elongated ring of flame outlets. The nozzle is associated with a simple tubular assembly for feeding powder to the nozzle. This type of gun cannot, per se, deliver a very wide fan shaped spray stream, and does not provide control of temperature conditions for effective melting without overheating.

It also is possible to assemble several complete gun heads as taught in U.S. Pat. No. 3,028,257 (Svrchek et al) for spraying resins over extended areas. This, also, is cumbersome and susceptible to unevenness in coating thickness.

Therefore an object of the present invention is to provide a novel thermal spray gun for producing a fan-shaped spray stream. Another object is to provide a thermal spray stream for coating large areas with uniformity and efficiency. A further object is to provide a novel construction for a compact thermal spray gun producing a fan spray. Yet another object is to provide a thermal spray gun with a fan spray having controllable heating of spray powder.

SUMMARY OF THE INVENTION

The foregoing and other objects are achieved by a thermal spray gun for projecting a fan-shaped spray stream, including first flame means for producing a first fan-shaped flame, and second flame means for producing a second fan-shaped flame spaced from the first flame parallel thereto in sufficient proximity for the first flame and the second flame to commingle into a combined fan-shaped flame. Powder dispersing means disperses heat-fusible powder entrained in a carrier gas flow into a fan-shaped powder spray parallel to and between the first flame and the second flame such that the powder is entrained into the combined flame. The powder dispersing means comprises dividing means receptive of the powder-carrier flow for dividing the same into a first stream and a second stream, and a gun body disposed between the first flame means and the second flame means. The gun body has a first powder duct therein receptive of the first stream, a second powder duct therein receptive of the second stream, and a fan-shaped powder chamber with an open side opening forwardly from the gun body between the first flame and the second flame and with an apex location opposite the open side. The first powder duct and the second powder duct each terminate at the apex location with a common axis perpendicular to the fan-shaped chamber such as to mutually impinge the first stream and the second stream into a combined powder stream dispersing through the fan-shaped powder chamber into the fan-shaped powder spray.

Preferably the thermal spray gun further includes gas means for introducing an auxiliary gas such as air into the combined flame in the form of a first fan-shaped gas flow and a second fan-shaped gas flow. The first fan-shaped gas flow is introduced between the first flame and the fan-shaped powder spray, and the second fan-shaped gas flow is introduced between the second flame and the fan-shaped powder spray. The fan-shaped flows may be effected with the gun body having a first fan-shaped gas chamber with a first open gas injection side opening from the gun body between the first flame and the powder spray and with a first gas apex location opposite the first open gas side. The gun body also has a second fan-shaped gas chamber with a second open gas injection side opening from the gun body between the second flame and the powder spray and with a second gas apex location opposite the second open gas side. The first and second gas apex locations are each receptive of a source of pressurized gas.

According to a preferred embodiment, the gun body comprises a plurality of laminated members cooperatively forming the fan-shaped powder chamber and the first and second gas chambers. The laminated members comprise first and second inner plates, first and second intermediate flames, first and second gaskets, and a resilient sheet. The gaskets and the sheet each have a generally triangular portion removed from a forward end thereof. The inner plates sandwich the sheet therebetween cooperatively to form a fan-shaped powder chamber. The first inner plate and the first intermediate plate sandwich the first gasket therebetween cooperatively to form a first fan-shaped gas chamber, and the second inner plate and the second intermediate plate sandwiching the second gasket therebetween cooperatively to form the second fan-shaped gas chamber.

DETAILED DESCRIPTION OF THE INVENTION

Figure 1:
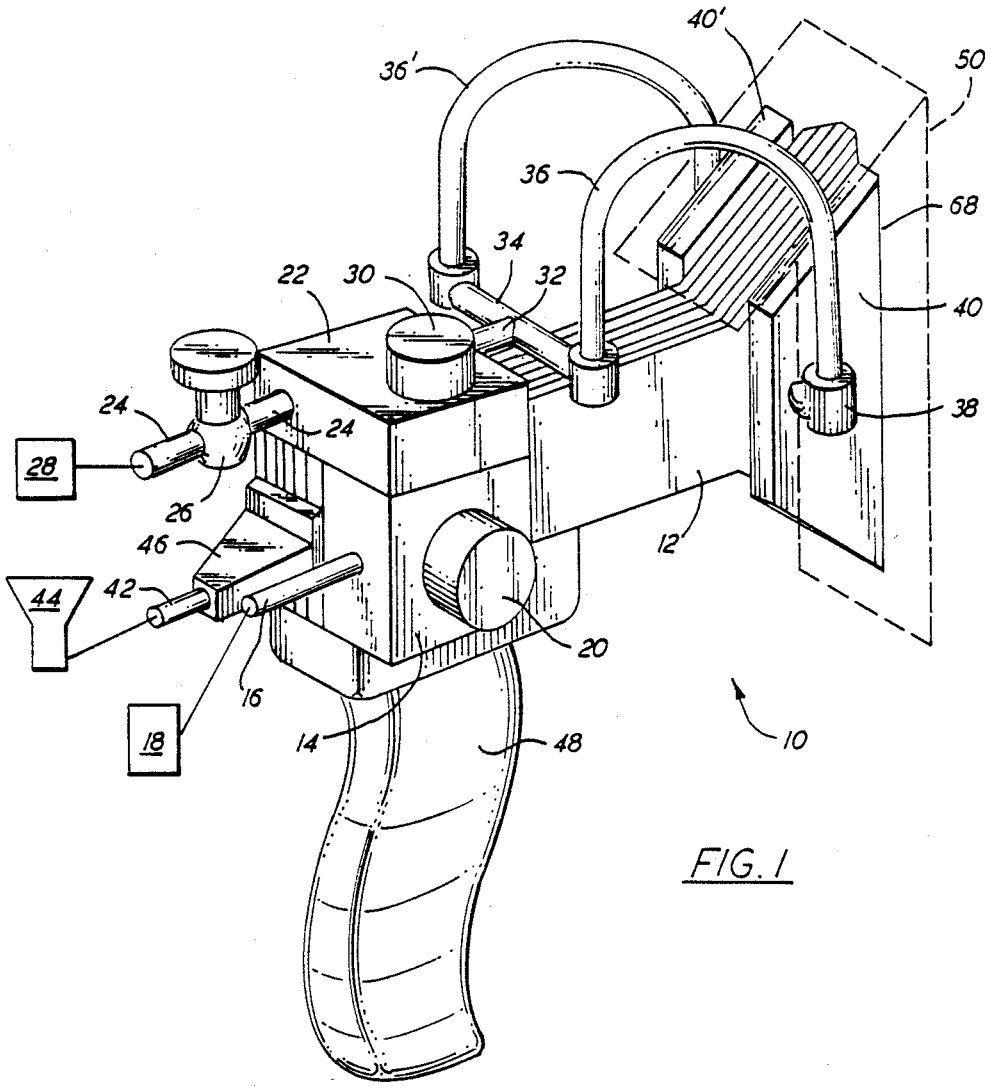
FIG. 1 is a perspective view of a thermal spray gun according to the present invention.

FIG. 1 shows an overall view of a thermal spray gun 10 according to the present invention. A gun body 12 is conveniently constructed by laminating six plates with slots, grooves and holes therein to form gas and powder flow ducts and chambers as described in detail below. An air distribution block 14 is mounted on one side of gun body 10 at the rear. This block receives pressurized air through a tube fitting 16 connected to a source 18 of the compressed air (shown schematically). Air flow into the gun body is selectively metered with a knob 20 on the side of block 14. Air also is channelled up into a mixing block 22 mounted on top of gun body 10 and distribution block 14.

Mixing block 22 receives combustion gas by way of a gas tube 24 with a metering valve 26 therein from a source 28 of the combustion gas (shown schematically). Air from distribution block 14 is controlled by a second knob 30 and is mixed with the combustion gas in mixing block 22. The air-gas mixture is directed out of mixing block 22 through a tube 32 connected to a "T" fitting 34 for separating the mixture into two flows in curved tubings 36,36' leading to gas fittings 38,38' (the latter is hidden) on respective flame means comprising burner members 40,40'. These burners are mounted on each side of gun body 12 at the front end. (The terms "front" and "forward" herein and in the claims mean the end of the gun from which the flames and spraying are effected; "rear" means the other end.)

Powder entrained in a carrier gas such as air is conveyed through a hose 42 from a conventional powder feeder 44 to a powder dividing block 46 mounted on the rear of gun body 12.

A handle 48 and/or a machine mounting post (not shown) is attached to the bottom of gun body 12. A shield 50 constructed of sheet metal is optionally mounted over the front end of the gun; this is shown in FIG. 1 by dashed lines for better view of the gun components. The gun is constructed generally of brass, copper and/or aluminum or the like, with conventional gasket material (e.g. paper type) between the plates and other components. Fasteners including screws are conventional and are omitted herein for simplicity and clarity.

Figure 2:
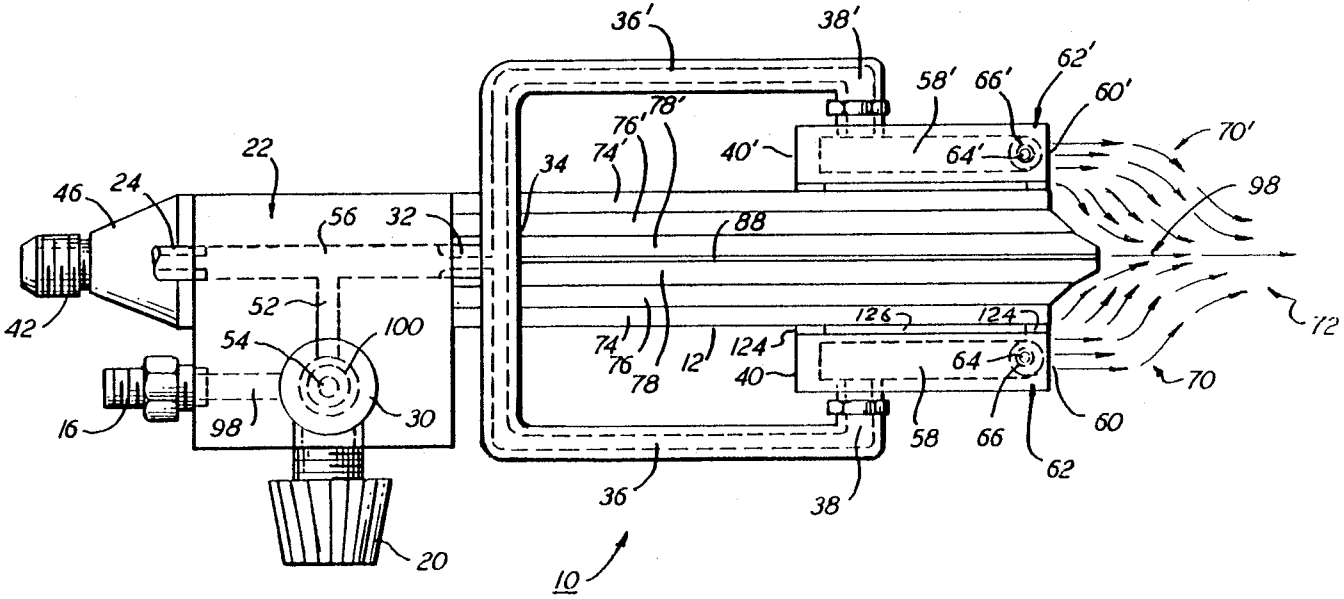
FIG. 2 is a top view of the gun of FIG. 1.

FIG. 2 is a top view of thermal spray gun 10, particularly showing the combustion system. An air channel 52 in mixing block 22 extends from a metering valve 54 controlled by knob 30, the air channel terminating at a combustion gas channel 56 from tube 24. The air and gas mix in channel 56 and the mixture is directed to "T" fitting 34. The separate branches of the mixture flow through tubings 36,36' and gas fittings 38,38' into respective manifolds 58,58' inside burners 40,40'. The manifolds open forwardly into the atmosphere with longitudinal openings 60,60' extending vertically across the front ends of the burners. Two flame retainers 62,62' on burners 40,40' are each in the form of a straight wire 64,64' extending vertically for the length of the opening and sheathed with wire mesh 66,66, to essentially fill the width of each opening. As may be seen in FIG. 1, burners 40,40' are trapezoidal in shape with the long side 68 (trapezoidal base) at the front. Therefore the flames 70,70' (FIG. 2) issuing from the front end fan out as vertically oriented flat flames. These two flames are parallel to each other and, although spaced apart at the gun, are in sufficient proximity to each other to commingle into a combined fan-shaped flame 72 a short distance away from the front end of the gun.

The mixer and burners described herein are particularly useful with propane or the like and are for thermal spraying low melting materials such as zinc or a thermoplastic resin powder. Other manifolds and burners may be constructed conventionally to produce similarly arranged fan-shaped flames for spraying other materials. For example oxy-acetylene may be used for spraying higher melting point thermal spray metals and ceramics, in which case the mixer and burners would be modified accordingly, to produce fanned oxy-acetylene flames on both sides of the gun body.

FIG. 2 also shows the convenient construction of laminated members which include the six plates with gaskets therebetween. Outer plates 74,74' have flat front ends and intermediate plates 76,76' and inner plates 78,78' are progressively longer and angled to form a generally pointed edge on the gun, from the top view, but with the tip being flattened somewhat. The plates are, for example, formed of ⅛ inch (0.32 cm) thick metal plate.

Figure 3:
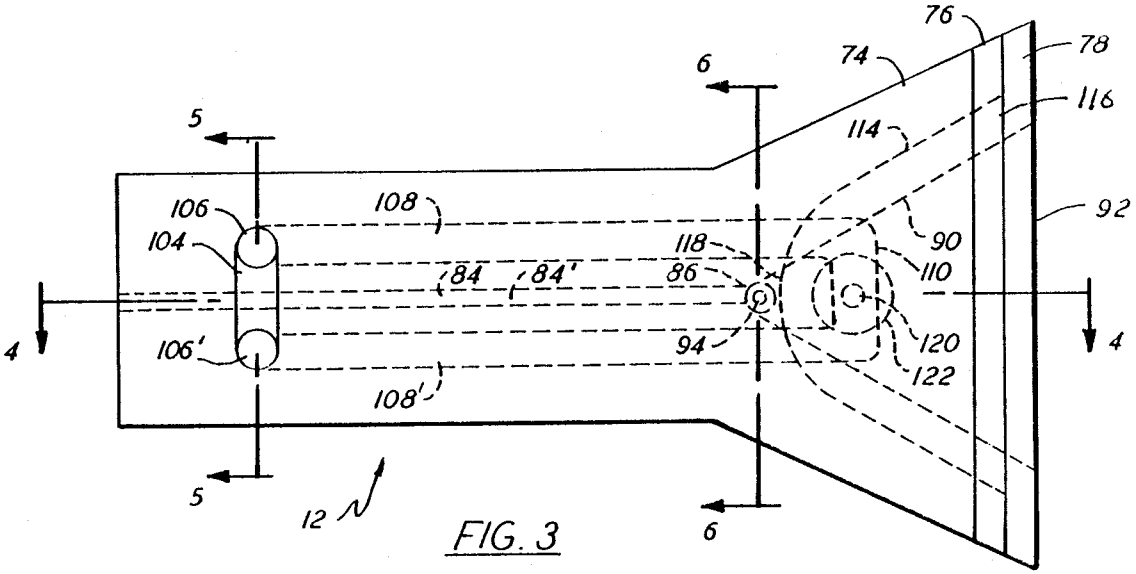
FIG. 3 is a side view of a gun body portion of FIG. 1.
Figure 4:
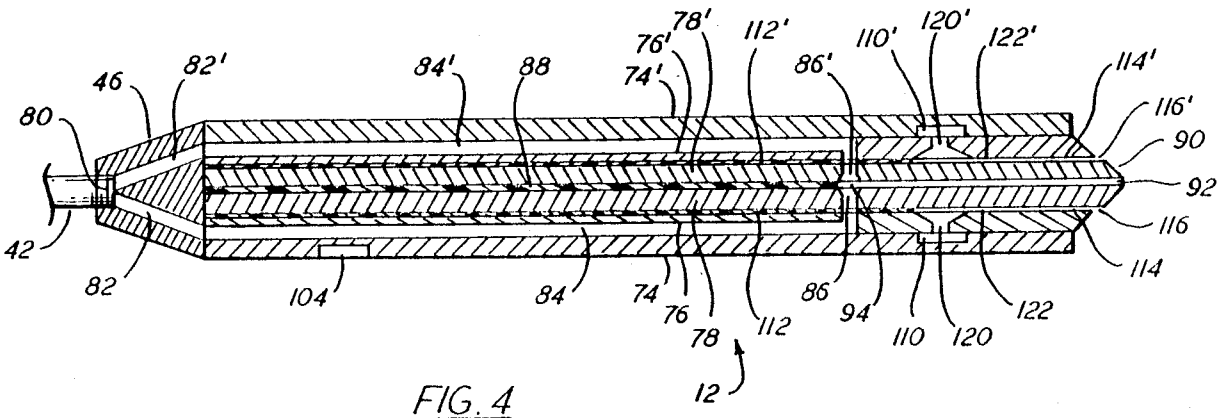
FIG. 4 is a longitudinal sectional view taken at 4—4 of FIG. 3.
Figure 5:
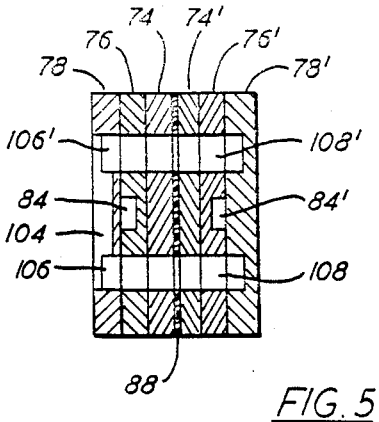
FIG. 5 is a cross-sectional view taken at 5—5 of FIG. 3.
Figure 6:
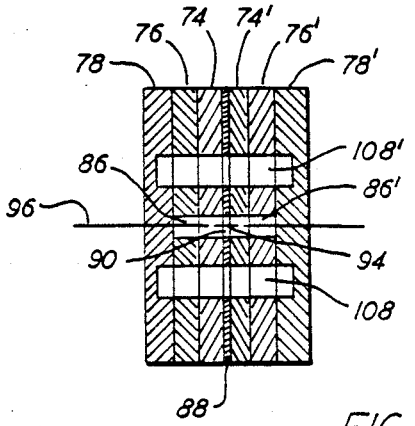
FIG. 6 is a cross-sectional view taken at 6—6 of FIG. 3.

A side view of gun body 12 may be seen in FIG. 3 which shows, with broken lines, channeling and chambers therein. Referring first to the longitudinal cross section FIG. 4, powder-carrier gas is received via tube 42 at an inlet opening 80 in dividing block 46 and divided into first and second streams in two branch ducts 82,82'. These ducts meet with two longitudinal ducts 84,84' in the gun body (FIGS. 3, 4, and 5). The longitudinal ducts are formed as slots in respective intermediate plates 76,76' and terminate at respective transverse powder ducts 86,86' extending inwardly from plates 76,76' through inner plates 78,78' (FIGS. 3, 4 and 6).

Referring to FIG. 4, inner plates 78,78' sandwich therebetween a sheet 88 of firm but resilient material such as plastic, e.g. polytetrafluoroethylene or the like which functions, inter alia, as a gasket seal. At the front of the gun body sheet 88 has a generally triangular portion removed so that a fan-shaped chamber 90 is formed in the gun body between the inner plates, i.e. vertically in the center of the gun. The chamber is shown bounded by a broken line in FIG. 3. The front ends of the plates forming the gun body are flared as required to accommodate this fan chamber and further chambers to be described. The chamber has an open side 92 which opens from the front of the gun, and an apex location opposite the open side at the meeting point 94 of powder ducts 86,86'. The compressed thickness of the plastic sheet and, therefore, the thickness of the fan chamber, should be between about 0.8 and 1.5 mm, preferably 0.8 and 1.0 mm. The transverse ducts have a diameter, for example, of 2.8 mm.

Transverse powder ducts 86,86', according to the present invention, have a common axis 96 (FIG. 6) perpendicular to fan-shaped chamber 90 such that the first and second powder carrier streams mutually impinge on each other in the apex location. By having the powder impinge on itself wear on the associated gun components is thereby minimized and, also, the powder is efficiently dispersed. The combined powder stream spreads through chamber 90 into a fan-shaped powder stream 98 (FIG. 2) between the first and second flames. The fanned powder stream will be entrained into combined flame 72 to heat soften or melt the powder an deposit it on a workpiece to form a coating thereon. The fan shape of the spray allows wide area passes to be made over the workpiece, especially useful for the spraying of large areas.

The right angle turn for the powder at the intersection of powder ducts 84,84' and respective ducts 86,86' could cause wear at the turn. Such wear may be substantially eliminated by extending the length of longitudinal ducts 84,84' beyond the intersections with transverse ducts by a distance (not shown) of about 1 or 2 widths of ducts 84,84'. The extensions will fill with powder, and such powder fill will take the brunt of the flowing powder taking the turn.

Figure 7:
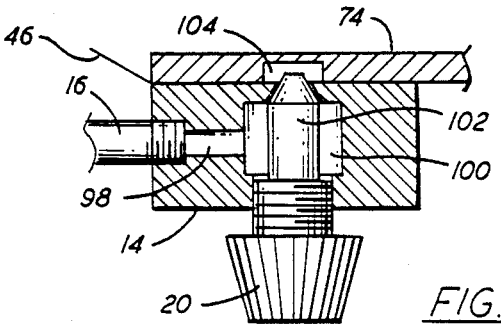
FIG. 7 is a horizontal cross-sectional view of a distribution block portion of FIG. 1.

For spraying low melting point materials it is desirable to incorporate an auxiliary gas such as additional air or other non-combustible (e.g. inert) gas into the spray stream. Alternatively additional heat may be required for high spray rate or high melting materials, in which case the gas may be a combustion gas. The following is a description for air, but it will be appreciated that other gases may be substituted. Referring to FIG. 7, distribution block 14 channels pressurized air via tube 16 and an inlet air channel 98 to an air chamber 100. An adjustable metering valve 102 on knob 20 meters air into an inlet slot 104 (FIG. 4) in outer plate 74 of gun body 12. (Air is also directed upwardly from chamber 100 to mixing block 22 for utilization as described above.) If a gas other than air is used, or if the combustion support is with oxygen, then the distribution block is replaced by separate inlet systems.

Referring to FIG. 3, slot 104 directs air through two short holes 106,106' to two relatively large air channels 108,108' running lengthwise in the gun body. These channels are formed cooperatively by grooves in outer plates 74,74' and aligned slots in the other plates, as also shown in FIGS. 5 and 6. Similarly slotted gaskets including central plastic sheet 88 between the plates seal the channels as well as the powder ducts 84,84',86,86'. Toward the front end of gun body 12 a pair of vertical channels 110,110' (FIGS. 3 and 4) connect air channels 108,108'. Respective gaskets 112,112' between intermediate plates 76,76' and adjacent inner plates 78,78' (FIG. 4) have generally triangular portions removed therefrom to form 15 respective first and second fan-shaped air chambers 114,114' in the forward portion of the gun body, chamber 114 being shown bounded by a broken line in FIG. 3.

Chambers 114,114' have respective first and second open air injection sides 116,116' that open from the front end of gun body 12. The chambers further have respective first and second gas apex locations 118,118' opposite the open sides. A first beveled orifice 120, issues pressurized air from one vertical channel 110 into first chamber 114 proximate the first apex location 118, and a second beveled orifice 120' issues pressurized air from the other vertical channel 110' into second chamber 114' proximate second apex location 118' The fan chambers 114,114' for the air should be quite thin, for example between about 0.4 and 0.8 mm, preferably 0.4 and 0.5 mm, to provide relatively high velocity sheets of air. Diameter of the orifices 120 into the fan chambers, for example, is 2.8 mm diameter with a bevel to an opening 122,122' of 15.9 mm diameter.

Thus first and second fan-shaped flows of compressed air (or other gas) are introduced respectively between the first flame and the fan-shaped powder spray and between the second flame and the powder spray. The air provides some acceleration to the spray stream and becomes entrained in the combined flame, cooling the flame for heat sensitive materials. The air flow is adjustable to provide control over the combined heating effect of the flame on the powder, so as to sufficiently heat soften the powder without overheating.

Provision may be made for entraining further air into the spray stream. This may be effected by mounting burners 40,40' on the gun body with spacers 124 (FIG. 2) to provide a slot 126 between each burner and the body, allowing air to be drawn therethrough.

Following are several examples of operation of the above-described thermal spray gun according to the present invention.

EXAMPLE 1

A −67+38 microns powder blend of 50% copper and 50% epoxy, by volume, is sprayed on the bottom of a fiberglass boat to provide antifouling for immersion in sea water. Spray parameters are propane at 3.3 bar and 1.6 l/min flow, air mixed with the propane at 3.3 bar and 32 l/min, auxiliary air at 3.3 bar and about 40 l/min, spray rate 7 kg/hr, spray distance 10 to 15 cm. The plastic is heat softened sufficiently to incorporate into the coating the copper powder which is not actually melted. Deposit efficiency is 80–90% and uniformly thick coatings of about 0.3 mm are effected.

EXAMPLE 2

A similar size zinc powder is sprayed onto a large steel structure for corrosion protection. Parameters are similar to those of Example 1 except propane flow is increased to 2.0 l/min and mix air to 45 l/min, and auxiliary air flow is eliminated, to provide increased heat to melt the zinc. A corrosion resistant coating of uniform thickness of about 0.15 mm is effected.

EXAMPLE 3

A gun similar to the above-described gun is constructed to provide a pair of rows of oxy-acetylene flame jets in place of the propane burners. Aluminum powder is sprayed onto a steel structure using the auxiliary air flow of Example 1, acetylene at 1 bar and 15 l/min flow, and oxygen at 2 bar and 28 l/min flow. Results similar to those of Example 2 are effected.

While the invention has been described above in detail with reference to specific embodiments, various changes and modifications which fall within the spirit of the invention and scope of the appended claims will become apparent to those skilled in this art. The invention is therefore only intended to be limited by the appended claims or their equivalents.

What is claimed is:

1. A thermal spray gun for projecting a fan-shaped spray stream, including first flame means for producing a first fan-shaped flame, second flame means for producing a second fan-shaped flame spaced from the first flame parallel thereto in sufficient proximity for the first flame and the second flame to commingle into a combined fan-shaped flame, and powder dispersing means for dispersing heat-fusible powder entrained in a carrier gas flow into a fan-shaped powder spray parallel to and between the first flame and the second flame such that the powder is entrained into the combined flame, the powder dispersing means comprising dividing means receptive of the powder-carrier flow for dividing the same into a first stream and a second stream, and a gun body disposed between the first flame means and the second flame means, the gun body having a first powder duct therein receptive of the first stream, a second powder duct therein receptive of the second stream, and a fan-shaped powder chamber with an open side opening forwardly from the gun body between the first flame and the second flame and with an apex location opposite the open side, the first powder duct and the second powder duct each terminating at the apex location with a common axis perpendicular to the fan-shaped chamber such as to mutually impinge the first stream and the second stream into a combined powder stream dispersing through the fan-shaped powder chamber into the fan-shaped powder spray.

2. A thermal spray gun according to claim 1 wherein the gun body comprises a pair of plates and a resilient sheet having a generally triangular portion removed from a forward end thereof, the plates sandwiching the sheet therebetween cooperatively to form the fan-shaped powder chamber corresponding to the triangular portion removed.

3. A thermal spray gun according to claim 1 further including gas means for introducing auxiliary gas into the combined flame in the form of a first fan-shaped gas flow and a second fan-shaped gas flow, the first fan-shaped gas flow being introduced between the first flame and the fan-shaped powder spray, and the second fan-shaped gas flow being introduced between the second flame and the fan-shaped powder spray.

4. A thermal spray gun according to claim 3 wherein the gas means comprises a portion of the gun body having a first fan-shaped gas chamber with a first open gas injection side opening from the gun body between the first flame and the powder spray and with a first gas apex location opposite the first open gas side, and a further portion of the gun body having a second fan-shaped gas chamber with a second open gas injection side opening from the gun body between the second flame and the powder spray and with a second gas apex location opposite the second open gas side, the first and second gas apex locations each being receptive of a source of pressurized gas.

5. A thermal spray gun according to claim 4 wherein the first flame means comprises a first burner member mounted on the gun body with a first space therebetween, and the second flame means comprises a second burner member mounted on the gun body with a second space therebetween, such that air is entrained by the first and second fan-shaped gas flows respectively from the first and second spaces.

6. A thermal spray gun according to claim 4 wherein the gun body comprises a plurality of laminated members cooperatively forming the fan-shaped powder chamber and the first and second gas chambers.

7. A thermal spray gun according to claim 6 wherein the plurality of laminated members comprises first and second inner plates, first and second intermediate plates, first and second gaskets, and a resilient sheet, the gaskets and the sheet each having a generally triangular portion removed from a forward end thereof, the inner plates sandwiching the sheet therebetween cooperatively to form the fan-shaped powder chamber, the first inner plate and the first intermediate plate sandwiching the first gasket therebetween cooperatively to form the first fan-shaped gas chamber, and the second inner plate and the second intermediate plate sandwiching the second gasket therebetween cooperatively to form the second fan-shaped gas chamber.

8. A thermal spray gun according to claim 7 wherein the plurality of laminated members further comprises first and second outer plates disposed outwardly of the first and second intermediate plates respectively and in sealing relationship therewith, the laminates having formed therein the first and second powder ducts and gas channeling, the gas channeling being receptive of the pressurized gas and in gas flow relationship with the first and second gas chambers.

9. A thermal spray gun according to claim 3 further including metering means for setting respective flow rates of the first and second gas flows.

10. A thermal spray gun according to claim 1 wherein the gun body comprises a pair of plates and a sheet having a generally triangular portion removed from a forward end thereof, the plates sandwiching the sheet therebetween cooperatively to form the fan-shaped powder chamber corresponding to the triangular portion removed.

* * * * *